United States Patent [19]

Mori et al.

[11] Patent Number: 4,477,704

[45] Date of Patent: Oct. 16, 1984

[54] POWER SWITCHING DEVICE

[75] Inventors: Teijiro Mori, Hyogo; Shigeru Masuda, Nagoya; Hiroyuki Okado, Nagoya; Masahiro Kakizoe, Nagoya; Yuji Sako, Nagoya, all of Japan

[73] Assignee: Mitsubishi Denki Kabushiki Kaisha, Tokyo, Japan

[21] Appl. No.: 461,362

[22] Filed: Jan. 27, 1983

[30] Foreign Application Priority Data

| | | | |
|---|---|---|---|
| Jan. 28, 1982 | [JP] | Japan | 57-12211 |
| Mar. 31, 1982 | [JP] | Japan | 57-52623 |
| Mar. 31, 1982 | [JP] | Japan | 57-52624 |

[51] Int. Cl.[3] ..... H01H 9/30

[52] U.S. Cl. ..... 200/144 R; 200/147 R

[58] Field of Search ..... 200/144 R, 144 A, 144 C, 200/144 AP, 147 R, 147 A, 147 B

[56] References Cited

U.S. PATENT DOCUMENTS

| | | | |
|---|---|---|---|
| 3,114,814 | 12/1963 | Stettner | 200/144 R X |
| 4,237,355 | 12/1980 | Fechant et al. | 200/147 R |

OTHER PUBLICATIONS

Motor Contactors of Compact Design for the World Market, *Siemens review*, vol XLI, No. 12, Dec. 1974, pp. 562–566.

*Primary Examiner*—A. D. Pellinen
*Assistant Examiner*—Morris Ginsburg
*Attorney, Agent, or Firm*—Sughrue, Mion, Zinn, Macpeak and Seas

[57] ABSTRACT

A power switching device including a fixed contact, a movable contact, an arc runner for transferring a leg of an electric arc to the outside of the fixed contact, a U-shaped fixed contactor electrically connected to the fixed contact, and a deionizing grid for extinguishing the arc. The side of the fixed contact is opposed to the side of the arc runner in three directions. At least the portion of the arc runner close to the fixed contact is kept away from the fixed contact and is physically separated therefrom by an electrically insulating medium. The arc runner is fixed and connected to a portion of the fixed contactor which is on the opposite side of the deionizing grid with respect to the fixed contact. Further, the runner extends so that it forms a continuous path along which the arc runs. Accordingly, after the arc has been transferred to the runner, it is urged toward the deionizing grid, thereby assuring continuous and smooth movement of the arc. Thus, a situation in which the arc is moved away from the grid resulting in incomplete extinction of the arc is prevented.

10 Claims, 32 Drawing Figures

POWER SWITCHING DEVICE

BACKGROUND OF THE INVENTION

The present invention relates to a power switching device which has fixed and movable contacts and is used to control the supply of electric power by causing the movable contact to make and break contact with the fixed contact. More particularly, the invention relates to such a power switching device having a stable breaking performance.

Referring to FIGS. 1–4, there is shown a conventional power switching device. As shown in FIG. 1, a mount 1 made of steel plate is provided with a plurality of holes 1*a* (FIG. 3) for installing the mount on the body of the switching device. A base 2 of insulating material is securely fixed to the mount 1 with screws 3 (FIG. 3). Installed on a fixed iron core 4, which is provided by laminated silicon steel plates, is an operation coil 5. A leaf spring 6 serving as a shock absorber is mounted in the gap formed between the core 4 and the mount 1. A movable iron core 7, which is disposed in opposition to the fixed core 4, is attracted to the core 4 when the coil 5 is energized. An insulating crossbar 8 is connected to the core 7 via a pin 9. A trip spring 10 (FIG. 2) disposed between the crossbar 8 and the mount 1 normally urges the crossbar upward to open the main circuit of the switching device. A movable contactor 11 incorporating a movable contact 11*a* which is inserted into a hole 8*a* (FIG. 2) of the crossbar 8 and is secured by a spring 12. A fixed contactor 13, which includes a fixed contact 13*a* opposed to the contactor 11 and to the contact 11*a*, is securely fixed to a terminal 15 with screws 14. The terminal 15 is secured to the base 2 with screws 16 and 17.

An arc runner 13*b* is electrically connected to the fixed contactor 13, but it is also possible to make the runner integral with the contactor 13. A terminal screw connected with the electric wire of the main circuit is joined to the terminal 15. An arc box 19 made from insulating material and securely fixed to the base 2 with screws 20 (FIG. 2) includes a top portion 19*b* and a side plate 19*c*. The box is provided with holes 19*a*, through which gas which can cause arcing is expelled. A deionizing grid 21 made from magnetic material is formed in a shape as shown in FIG. 4. A commutator electrode 22 is securely fixed to the top portion 19*b* of the arc box 19. The movable contact 11*a* and the fixed contact 13*a* are disposed within the arc extinguishing chamber of the device.

In the operation of the power switching device described above, when a voltage is applied to the operation coil 5 in the open-circuit condition of the main circuit, magnetic flux is developed between the fixed core 4 and the movable core 7, whereby the core 7 is attracted to the core 4 against the resilience of the spring 10. At the same time, the crossbar 8 operates in the same manner, and the movable contact 11*a* comes into contact with the fixed contact 13*a* thereby closing the main circuit. Thereafter, when the coil 5 is deenergized, the contact 11*a* is moved away from the contact 13*a*, resulting in arcing in the region as indicated by character A in FIG. 1 between the both contacts.

Referring next to FIGS. 5A–5F, the movement of the arc beginning with its generation and ending with the break of the current will now be described. (Since the arc extinction chamber is symmetrical, FIGS. 5A–5F show only one half of the chamber.) FIG. 5A shows that the contact 11*a* in contact with the contact 13*a*. Then, when the contact 11*a* is moved away from the contact 13*a*, an arc 23 is generated, as shown in FIG. 5B. The distance between the contacts becomes large with time until a certain distance is reached. The current flowing through the contactors 11 and 13 and the deionizing grid 21 drive and expand the arc 23, as shown in FIG. 5C. As a result, one end of the arc 23 is transferred from the surface of the contact 13*a* to the arc runner 13*b*, as shown in FIG. 5D. Then, dielectric breakdown takes place between the protrusion of the arc 23 resembling a circular arc (FIG. 5D) and portion B of the runner 13*b* (FIG. 5E) and the one end of the arc 23 is transferred to the portion B of the runner. Then, the other end of the arc 23 is transferred from the fixed contact 11*a* to the commutator electrode 22, as shown in FIG. 5F and, at the same time, the arc is attracted into the grid 21 and extinguished, thus completing the breaking operation.

The prior art power switching device thus constructed has some drawbacks. First, as one end of the arc 23 tends to stay on one end portion of the contact 13*a* and the other end on the surface of the contact 11*a*, the contacts 13*a* and 11*a*, which must be made from costly materials, are worn rapidly. Secondly, the arcing time is prolonged, making the energy lost in the arc quite high. Thus, it is impossible to break a large current.

In order to eliminate these disadvantages, an improved power switching device has been proposed. This improved device is similar to the conventional device of FIGS. 1–∝ except for its commutator electrode and arc runner. Referring to FIG. 6, such an improved commutator electrode 22 is shown. This electrode is provided with a space M and a planar portion N opposed to the deionizing grid 21. As can be seen from FIG. 6, the contact 11*a* and contactor 11 enter the space M in the electrode 22. That is, the device is so constructed that when the distance between the contacts reaches a maximum value, the commutator electrode 22 is located between the electrodes.

Referring next to FIGS. 7A and 7B, the arc runner 13*b* is brazed to a U-shaped fixed contactor 13, and the wall thickness Y1 of the runner is so selected that it is greater than the wall thickness X1 of the fixed contact 13*a*.

The movement of the arc 23 in this improved device will be described with reference to FIGS. 8A–8F. FIG. 8A shows the contact 11*a* in contact with the contact 13*a*. When the contact 11*a* is disengaged from the contact 13*a*, an arc 23 is developed between the contacts, as shown in FIG. 8B. As the distance between the contacts becomes large, both ends of the arc are rapidly transferred from the contacts to the commutator electrode 22 and to the runner 13*b*, respectively, as shown in FIG. 8C. The arc 23 is driven by the current flowing through both contactors 11 and 13. When transferred, the arc is acted upon by a strong magnetic field as indicated by arrow B in FIG. 6, the field being caused by both the current flowing through the contactor 11 and the electrode 22 made of magnetic material. At this time, a driving force F is generated which moves the arc 23 from the contact 11*a* to the electrode 22. The force F and the shape of the commutator electrode hasten this transfer. Since the runner 13*b* is made from magnetic material, the arc 23 is attracted to the runner 13*b*, and the leg of the arc is rapidly transferred from the contact 13*a* to the runner. Then, the arc 23 is driven and expanded by the current flowing through the electrode 22 and the contactor 13, as shown in FIG. 8D, and thereafter it assumes the condition as shown in FIG. 8E. Finally, it is extinguished in the deionizing grid, as shown in FIG. 8F, completing the breaking operation.

In this manner, in the improved device, one end of the arc is transferred very rapidly from the movable contact 11*a* to the commutator electrode 22, and thus the contact 11*a* is worn away slowly. Further, the arcing time is shortened, thus reducing the arc energy. Hence the break performance is improved.

However, this improved device also has a disadvantage. In particular, the runner 13*b* is brazed to the contactor 13. The coupling ratio between the runner 13*b* and the contactor 13 expressed in terms of a percentage of the truly coupled area to the apparently coupled area is typically as low as 60% or so. In other words, the runner is actually only partially coupled to the contactor 13 due to voids in the braze. Further, it is impossible to control the positions at which the elements are not brazed together, and therefore every brazing provides different locations at which the runner 13*b* and contactor 13 are not brazed together. In uncoupled portions 24, as indicated by the hatching in FIG. 9, current will flow through the contactor 13 and then flow through the runner 13*b* in the direction indicated by the arrow in FIG. 9. Thereafter it flows into the arc 23, driving the arc in the direction away from the grid 21. Thus, the improved device is sometimes unable to effectively break the arc current.

SUMMARY OF THE INVENTION

In view of the foregoing drawbacks, it is an object of the present invention to provide a power switching device which is free from the aforementioned difficulties and is capable of always driving an arc toward its deionizing grid, and which therefore provides a stable breaking performance.

This object is accomplished by providing a power switching device in which the side of a fixed contact is opposed to the side of an arc runner in three directions and at least the portion of the runner close to the contact is physically separated from the contact by an electrically insulating medium, and in which the runner extends continuously along the path on which an arc runs to assure smooth movement of the arc.

One advantageous feature of the present invention is that the arc is always driven toward the deionizing grid, thus assuring a stable breaking performance.

It is another object of the invention to reduce the thermal damage to the arc box of the device so as to prevent an interphase short circuit which can occur when a hole is formed in the box resulting in failure of the insulation between neighboring phases.

This object is accomplished by a construction in which the arc runner tapers off in the direction in which an arc runs.

It is a further object of the present invention to prevent a break which is caused when the arc runner is bent and comes into contact with the grid.

This object is accomplished by providing protrusions on the arc runner to prevent the arc heat from deforming the runner.

DESCRIPTION OF THE PREFERRED EMBODIMENTS

Figure 1:
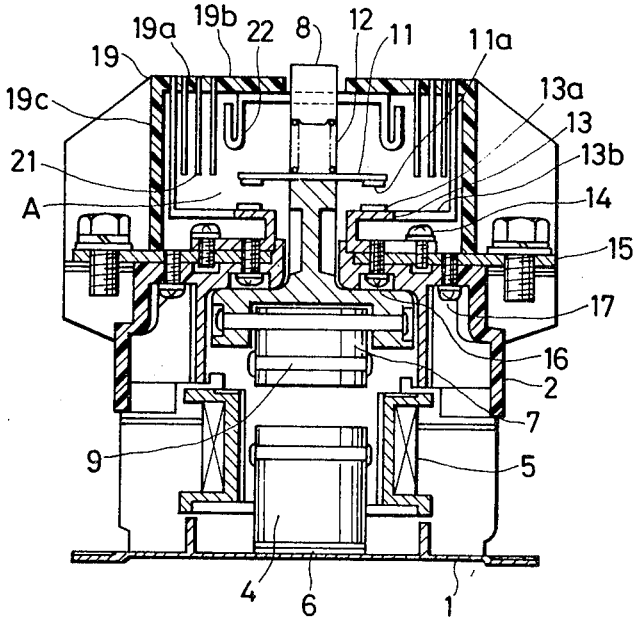
FIG. 1 PRIOR ART
FIG. 1 is a longitudinal cross sectional view in elevation of a conventional power switching device.
Figure 2:
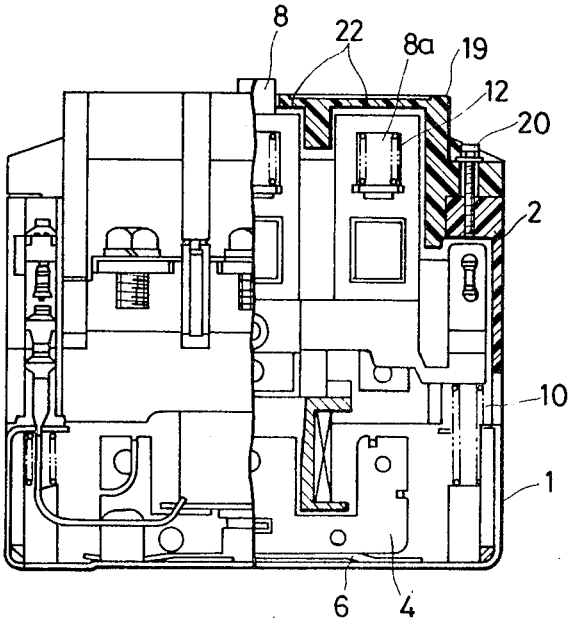
FIG. 2 PRIOR ART
FIG. 2 is a side elevation, partly in longitudinal section, of the device of FIG. 1.
Figure 3:
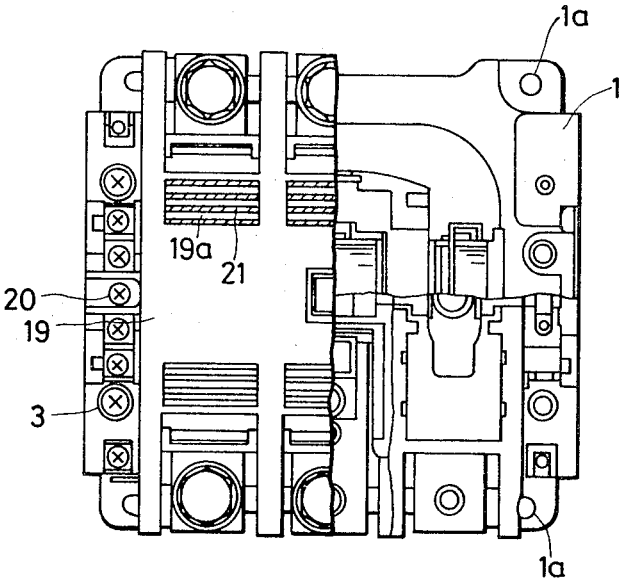
FIG. 3 PRIOR ART
FIG. 3 is a plan view, partly in transverse section, of the device of FIG. 1.
Figure 4:
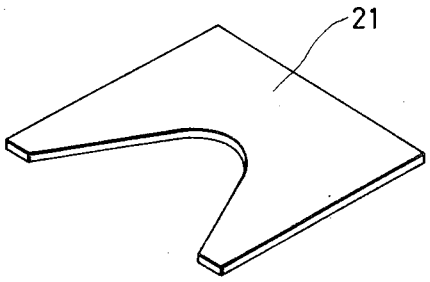
FIG. 4 PRIOR ART
FIG. 4 is a perspective view of a deionizing grid of the device shown in FIG. 1.
Figure 5A:
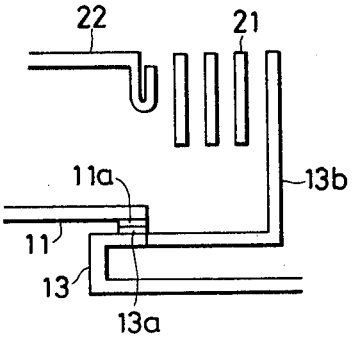
FIG. 5A PRIOR ART
FIGS. 5A–5F show the manner in which an arc moves in the device of FIG. 1.
Figure 5D:
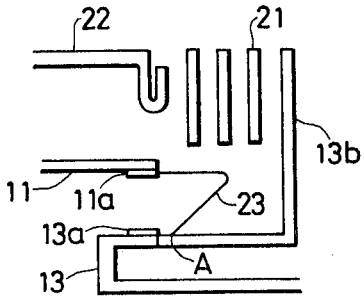
FIG. 5D PRIOR ART
Figure 5B:
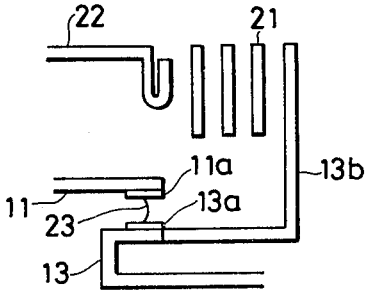
FIG. 5B PRIOR ART
Figure 5E:
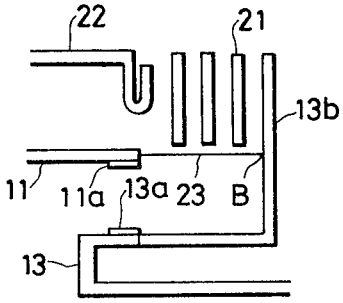
FIG. 5E PRIOR ART
Figure 5C:
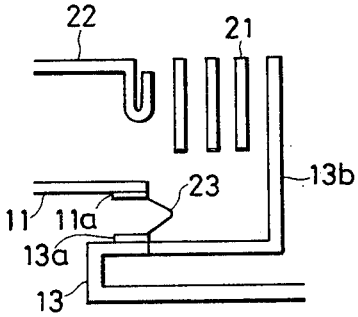
FIG. 5C PRIOR ART
Figure 5F:
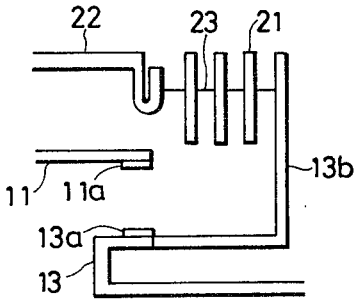
FIG. 5F PRIOR ART
Figure 6:
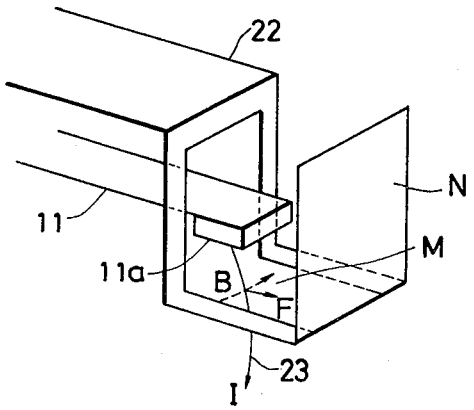
FIG. 6 PRIOR ART
FIG. 6 is a perspective view of an improved prior art commutator electrode.
Figure 7A:
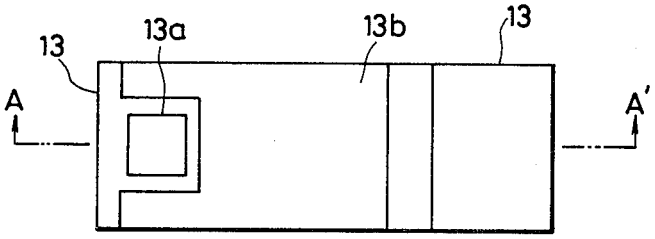
FIG. 7A PRIOR ART
FIG. 7A is a plan view of a fixed contactor and an arc runner associated with the electrode of FIG. 6.
Figure 7B:
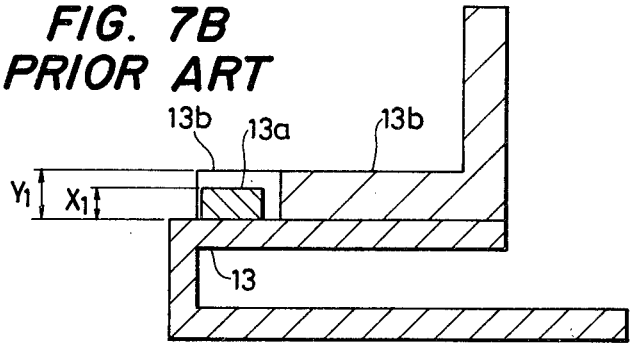
FIG. 7B PRIOR ART
FIG. 7B is a cross-sectional view taken on a line A–A′ in FIG. 7A.
Figure 8A:
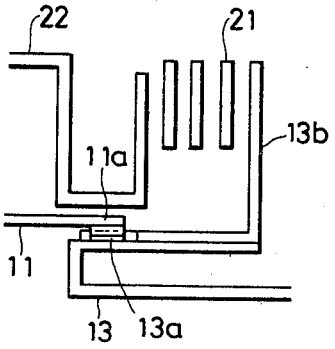
FIG. 8A PRIOR ART
FIGS. 8A–8F show the manner in which an arc moves in an improved, prior art switching device.
Figure 8D:
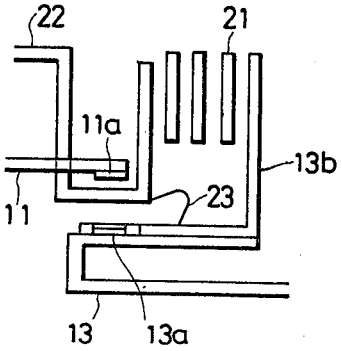
FIG. 8D PRIOR ART
Figure 8B:
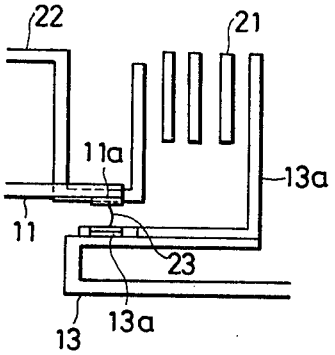
FIG. 8B PRIOR ART
Figure 8E:
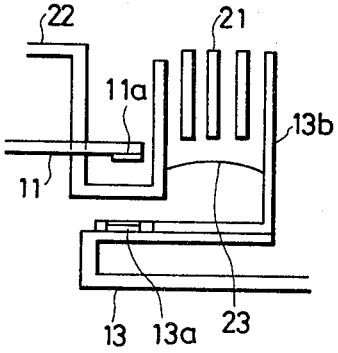
FIG. 8E PRIOR ART
Figure 8C:
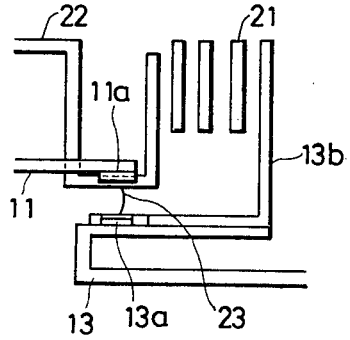
FIG. 8C PRIOR ART
Figure 8F:
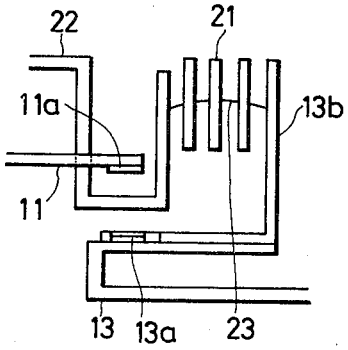
FIG. 8F PRIOR ART
Figure 9:
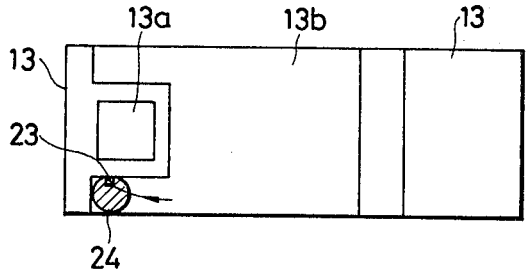
FIG. 9 PRIOR ART
FIG. 9 is a view similar to FIGS. 7A and 7B, but showing an uncoupled portion and the direction in which a current flows.
Figure 10A:
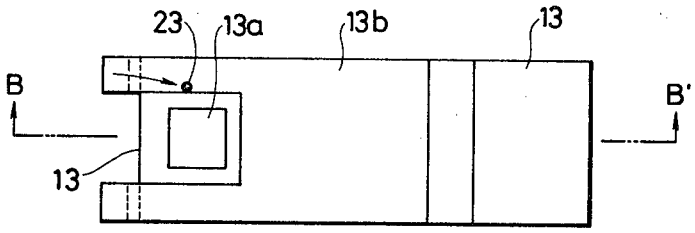
FIG. 10A is a plan view of a power switching device embodying the present invention.
Figure 10B:
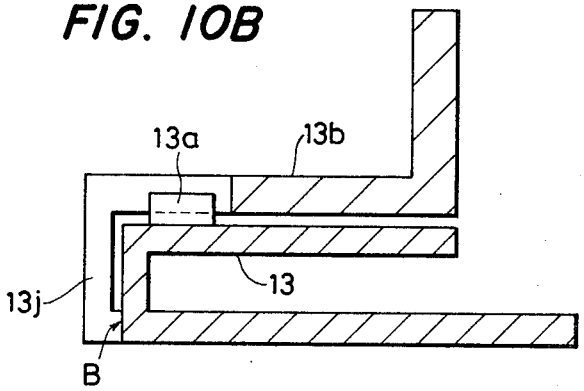
FIG. 10B is a cross-sectional view taken on a line B–B′ in FIG. 10A.

Referring to FIGS. 10A, 10B, 11 and 12, there are shown various examples of a power switching device according to the present invention. As shown in FIGS. 10A and 10B, the front end portion of an arc runner 13*b*, which is downwardly suspended and has a cut-out portion 13*j*, is brazed to the vertical portion of U-shaped fixed contactor 13 in an area B indicated in FIG. 10B. With this construction, current flows through the runner 13*b* in the direction indicated by the arrow in FIG. 10A, driving the arc 23 toward the deionizing grid 21. Stable breaking performance is thereby provided.

Figure 11:
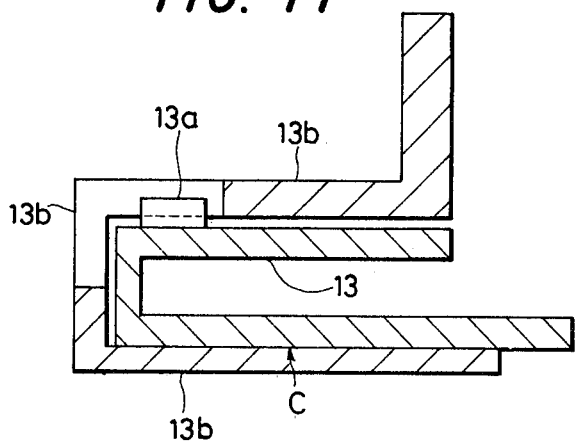
FIG. 11 is a longitudinal cross-section in elevation of another power switching device according to the invention.

Referring to FIG. 11, there is shown another power switching device of the invention in which the front end portion of the arc runner 13*b*, having a U-shape in section, is brazed to the lower portion of the U-shaped fixed contactor 13 in an area C.

Figure 12:
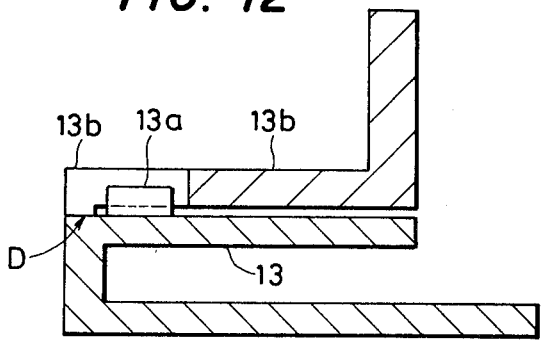
FIG. 12 is a longitudinal cross-section in elevation of still another power switching device according to the invention.

Referring to FIG. 12, there is shown a further device of the invention in which the front end portion of the upper surface of the fixed contactor 13 is brazed to the front end portion of an arc runner **13*b* in an area D. Instead of brazing, other coupling techniques such as bolting may be used to couple the runner 13*b* to the contactor 13**.

While the present invention has been described with reference to the case of an electromagnetic switching device which employs a magnet for controlling the passing and interrupting of a current, the invention can also be applied to a power switch, such as a molded-case circuit breaker.

Figure 13A:
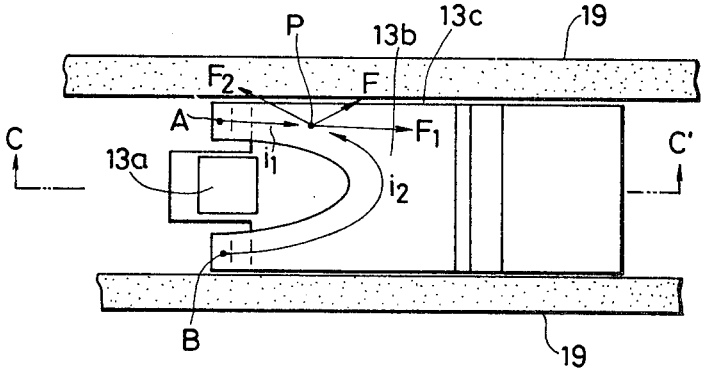
FIG. 13A is a detailed plan view of an arc runner shown in FIG. 12.
Figure 13B:
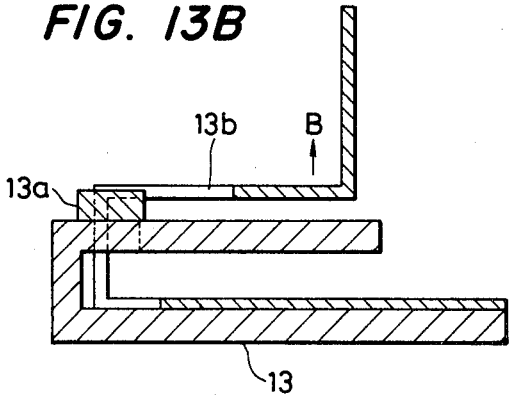
FIG. 13B is a cross sectional view taken on a line C–C′ in FIG. 13A.

This kind of electromagnetic switching device performs a stable breaking operation, but has a problem as described below. It is assumed that the leg of an arc is located at point P on arc runner **13*b* of an electromagnetic switching device having a structure as shown in FIG. 13A. In this situation, the arc rises vertically to the sheet surface from the point P, with the other end of the arc lying on the commutator electrode 22. As indicated by the arrows in FIG. 13A, currents flowing from the runner 13*b* into the arc are such that they leave points A and B on the runner 13*b* and merge at point P. Assume now that the current flowing from the point A to the point P is denoted by $i_1$ and another current flowing from the point B to the point P is denoted by $i_2$. Since the distance between the points A and P is smaller than the distance between the points B and P, the relation $i_1 > i_2$ holds. In FIG. 13A, $F_1$ and $F_2$ denote the respective forces exerted by the currents $i_1$ and $i_2$ driving the arc, and F denotes the combined force of $F_1$ and $F_2$. As the relation $i_1 > i_2$ holds, the relationship $F_1 > F_2$ is also valid. For this reason, the arc is subjected to the resultant force F as shown in FIG. 13A. The force F can be decomposed into a force exerted to the right and an upward force when viewed in FIG. 13A. The upward force drives the leg of the arc toward a side end 13*c* of the runner 13*b* and the leg is moved to the right along the side end 13*c*. A portion of arc box 19 is disposed near the side end 13*c* of the runner 13*b*** and, accordingly, the box can be damaged by the heat of the arc at that point. Consequently, after a number of breaking operations, it is possible for a hole to be formed in the box, resulting in failure of the insultation between neighboring phases and causing an interphase short circuit.

In further examples of electromagnetic switching devices of the invention, this phenomenon is prevented. Specifically, arc runner **13*b* as shown in FIGS. 14A and 14B** is provided with a surface on which an arc runs which tapers off in the longitudinal direction of the runner.

Figure 14A:
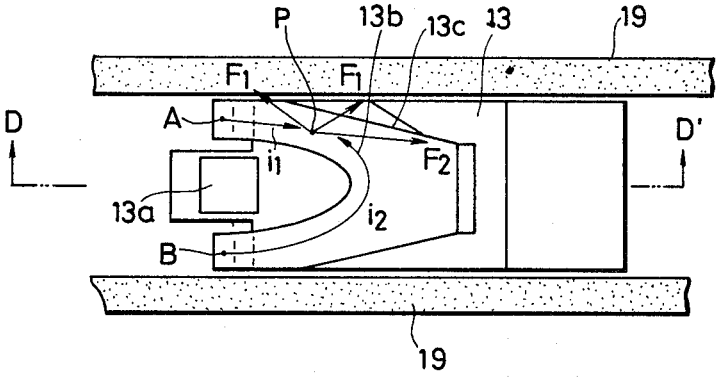
FIG. 14A shows the detailed construction of an arc runner used in another example of a power switching device according to the invention.
Figure 14B:
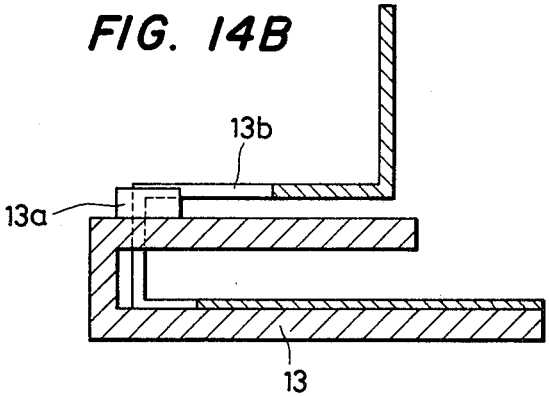
FIG. 14B is a cross-sectional view taken on a line D–D′ in FIG. 14A.

Referring particularly to FIG. 14A, it is assumed that the leg of an arc is located at point P on the runner **13*b*. The arc rises vertically to the sheet surface from the point P, while the other end of the arc is located on the commutator electrode 22. As shown in the figure, currents flowing from the runner 13*b* into the arc leave the points A and B and merge at the point P. Assume now that a current flowing from the point A to the point P is denoted by $i_1$ and that another current flowing from the point B to the point P is denoted by $i_2$. Since the distance between the points A and P is shorter than the distance between the points B and P, the relation $i_1 > i_2$ holds. Therefore, the force $F_1$ exerted on the arc by the current $i_1$ is greater than the force $F_2$ exerted by the current $i_2$. Although the arc is subjected to the combined force F of $F_1$ and $F_2$, the force F can be decomposed into a rightward force and an upward force, as seen in FIG. 14A. The upward force drives the leg of the arc toward the side 13*c* of the runner 13*b*. Thus, the leg of the arc runs along the side 13*c* of the runner to the right, moving away from arc box 19**. In this fashion, damage to the box by the arc heat is reduced.

Figure 15A:
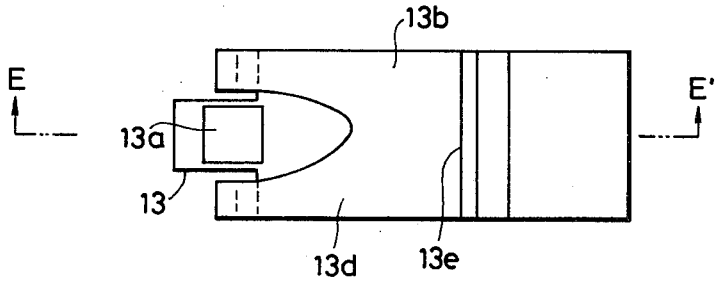
FIG. 15A is another detailed plan view of an arc runner shown in FIG. 13A absent housing 19.
Figure 15B:
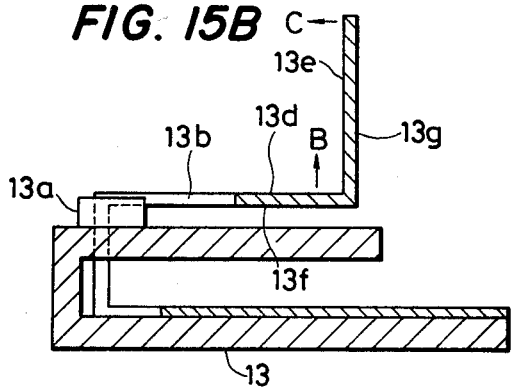
FIG. 15B is a cross-sectional view taken on a line E–E′ in FIG. 15A.

Further, it is also possible that a further problem may occur as follows. Referring to FIGS. 15A and 15B, when the load current is cut off, an arc will be produced, one leg of which will be located on the fixed contact **13*a*. The leg is then driven by the magnetic field generated by the current flowing through fixed contactor 13 and movable contactor 11, whereby it is transferred to arc runner 13*b*. Then it runs along surfaces 13*d* and 13*e* of the runner 13*b* and is cut off. At this time, the surfaces 13*d* and 13*e* of the runner are heated by the arc heat, but undersides 13*f* and 13*g* are not heated. As a result, the surfaces of the runner 13*b* are subjected to an unbalanced compressive force by the arc heat, thus bending the runner in the directions indicated by arrows B and C. After a number of operations of breaking load current, during which the bending accumulates, the runner 13*b* may come into contact with the grid 21**, resulting in failure of the device.

Figure 16A:
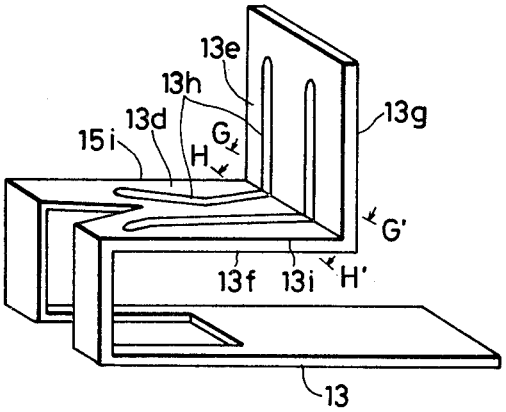
FIG. 16A is a detailed perspective view of an arc runner used in a further example of a power switching device according to the invention.
Figure 16B:
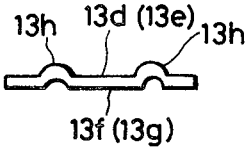
FIG. 16B is a cross-sectional view taken on the lines G–G′ and H–H′ in FIG. 16A.

Referring to FIGS. 16A and 16B, there is shown a still further example of a power switching device of the invention in which this problem is eliminated. As shown in FIG. 16A, arc runner **13*b* has upper surfaces 13*d* and 13*e* and undersides 13*f* and 13*g*. An arc runs along the surfaces 13*d* and 13*e* in the same manner as in the conventional device. FIG. 16B is a cross-sectional view taken on the lines G–G' and H–H' of FIG. 16A showing the runner 13*b***.

The surfaces **13*d* and 13*e* of the runner 13*b* as shown in FIGS. 16A and 16B are provided with protrusions 13*h*, which may be formed by extrusion. When the surfaces 13*d* and 13*e* of the runner are heated by the arc heat, these surfaces receive a compressive force in the same fashion as conventional electromagnetic switching devices. However, as the runner 13*b* in this example is provided with protrusions 13*h*, it can well withstand the force, thus preventing bending due to the compressive forces. In this way, the power switching device of this embodiment of the invention will not experience failure caused by the runner 13*b*** coming into contact with the grid.

Further, in the novel power switching device, as the runner **13*b* has protrusions 13*h*, an arc tends to run along the protrusions rather than outer edges 13*i*. Thus, thermal damage to the portion of the arc box 19** near the arc runner is reduced.

In the above example, each protrusion **13*h* is formed with a U-shape in section. However, the protrusions may take other forms. For instance, they may be formed in a shape while yet enjoying the same advantages without departing from the spirit of the invention. In addition, in the above example, the protrusions 13*h* are formed integrally with the runner 13*b* by bending. Instead of the protrusions 13*b***, members which are separate from the runner but made from the same material as the runner can yield the same advantages.

We claim:

1. A power switching device comprising:

a fixed contactor provided with a fixed contact;

a movable contactor provided with a movable contact opposed to said fixed contact, said movable contact being movably mounted for making and breaking contact with said fixed contact;

a deionizing grid disposed near said fixed and movable contactors, said grid acting to extinguish an electric arc which is developed when said movable contact moves away from said fixed contact; and an arc runner disposed near said fixed contactor and extending continuously in a direction in which said arc runs for transferring said arc beyond said fixed contact;

said arc runner being constructed such that a side of said fixed contact is surrounded by a side of the runner in three directions including said direction in which the arc runs toward said deionizing grid, said arc runner having a portion substantially parallel to said fixed contact close to but physically separated by an electrically insulating medium from said fixed contact, said runner having another portion being fixed and connected to a portion of said fixed contactor located on a side opposite to one on which said arc runs toward said deionizing grid with regard to said fixed contact; wherein said arc runner comprises a connecting portion fixed to said fixed contactor and an arc running portion having a horizontal section and a vertical section forming a continuous surface along which said arc runs to said deionizing grid, said vertical section located at an edge of said horizontal section remote from said fixed contact, said connecting portion being remote from said arc running portion.

2. The power switching device as set forth in claim 1, wherein physical separation by an electrically insulating medium of said portion of said runner close to said fixed contact from the fixed contact is achieved by locating said portion of the runner such that it is kept away from said fixed contactor with a gap therebetween.

3. The power switching device as set forth in claim 1, wherein said fixed contactor has a portion having a U-shape in section, the U-shaped portion having one leg on which said fixed contact is mounted, and other portions to which said arc runner is fixed and connected in such a manner that said runner is out of contact with said one leg.

4. The power switching device as set forth in claim 3, wherein said arc runner is shaped to be kept away from said fixed contactor except for said portion fixed and connected to said other portions of said fixed contactor.

5. The power switching device as set forth in claim 3, wherein said arc runner is fixed and connected to said U-shaped portion of said fixed contactor.

6. The power switching device as set forth in claim 3, wherein said arc runner is fixed to another leg on the opposite side of said one leg.

7. The power switching device as set forth in claim 1, wherein said arc runner is provided with an aperture surrounding said fixed contact in said three directions.

8. The power switching device as set forth in claim 7, wherein said aperture formed in said arc runner extends near to a portion of said runner which is fixed and connected to said fixed contactor.

9. The power switching device as set forth in claim 1, wherein said arc runner is formed so as to taper off in said direction in which the arc runs.

10. The power switching device as set forth in claim 1, wherein a surface of said arc runner along which said arc runs is provided with at least one protrusion.

* * * * *